United States Patent [19]

Bonhomme

[11] Patent Number: 4,705,336

[45] Date of Patent: Nov. 10, 1987

[54] PROCESSES FOR FABRICATING FEMALE ELECTRIC CONNECTOR ELEMENTS AND FEMALE CONNECTOR ELEMENTS THUS OBTAINED

[76] Inventor: François R. Bonhomme, 6 Parc de Béarn, 92 210 Saint Cloud, France

[21] Appl. No.: 814,963

[22] PCT Filed: May 6, 1985

[86] PCT No.: PCT/FR85/00108

§ 371 Date: Dec. 31, 1985

§ 102(e) Date: Dec. 31, 1985

[87] PCT Pub. No.: WO85/05229

PCT Pub. Date: Nov. 21, 1985

[30] Foreign Application Priority Data

May 7, 1984 [FR] France ..... 84 07045

[51] Int. Cl.[4] ..... H01R 11/00

[52] U.S. Cl. ..... 439/597; 439/587

[58] Field of Search ..... 339/59–61; 29/846, 847, 852

[56] References Cited

U.S. PATENT DOCUMENTS

| | | | |
|---|---|---|---|
| 4,118,092 | 10/1978 | Sado et al. | 339/59 M |
| 4,217,155 | 8/1980 | Fritz et al. | 156/55 |
| 4,416,498 | 11/1983 | Sado et al. | 339/60 R |
| 4,426,775 | 1/1984 | Faust et al. | 29/846 |

FOREIGN PATENT DOCUMENTS

| | | |
|---|---|---|
| 1174063 | 3/1959 | France . |
| 589290 | 6/1947 | United Kingdom . |
| 1163680 | 9/1969 | United Kingdom . |

*Primary Examiner*—Gil Weidenfeld
*Assistant Examiner*—Paula A. Austin
*Attorney, Agent, or Firm*—Larson and Taylor

[57] ABSTRACT

The connector is formed by at least two supports (1,2) of insulating material of which at least one is of an elastic plastics material and which are assembled together with one interior face against the other interior face. The profiles of these two supports (1,2) are such that, when thus assembled, they delimit therebetween a series of cavities (4) which open onto at least one of the transverse faces of the assembly (7) of the two supports. The interior face of at least one of these supports is coated with at least one metallized track at the place of each cavity (4).

14 Claims, 16 Drawing Figures

PROCESSES FOR FABRICATING FEMALE ELECTRIC CONNECTOR ELEMENTS AND FEMALE CONNECTOR ELEMENTS THUS OBTAINED

The design and construction of microminiature electric connectors, i.e. connectors assuring the connection by plugs whose diameter is less than or equal to 0.3 mm, encounter many difficulties. As is known, an electric connection generally uses a metallic plug and socket. It is clear that, in order to reduce as far as possible the overall size, it is necessary to place on the socket, and not on the plug, the elastically deformable device which assures the required pressure of contact, so as to permit the use of plugs whose diameter is less than 0.3 mm. If the socket is cylindrical, it is impossible to effect correctly an electrolytic deposit protecting the interior of this socket, owing to the fact that the interior diameter of the latter is substantially equal to the diameter of the plug.

Further, there are normally employed electric contact devices utilizing elastic metallic materials which assure the required pressure of contact, but which are generally unsuitable in the case of the small dimensions contemplated in this type of connector, in particular owing to the fabrication of the components and the assembly by means of automatic machines. In order to avoid the drawbacks resulting from the use of these elastic metallic materials, the applicant has already proposed, in French Pat. No. 1 174,063, to use a planar plastics cushion, for example of synthetic rubber, carrying on one of its planar faces copper deposits which are applied, by a relative transverse displacement brought about by exterior mechanical means, on the planar face of a printed circuit board so as to assure a contact between the usual conductive tracks of this board and the copper deposits of the elastic cushion.

The invention has for its object to develop a process for fabricating a female electric connector element adapted to cooperate with plugs having a diameter preferably at the most equal to 0.3 mm, characterized in that it comprises mainly separately forming two supports of an insulating material of which at least one is of an elastic plastics material, by giving to these supports such transverse profiles that, when these supports will be subsequently assembled together with one interior face against the other interior face, they delimit therebetween a series of parallel cavities which open onto at least one of the transverse faces of the assembly of the two supports; thereafter coating the interior face of at least one of these supports with at least one metallized track at the place of each cavity; and finally assembling the two supports in the above-mentioned manner. Of course, this definition of the process does not exclude the use of more than two supports for constituting the same female connector element, provided that each cavity is delimited by two of such supports of which at least one is of elastic plastics material.

With this process, it is possible to form cavities whose diameter of the circle inscribed within their cross-section is very small, i.e. preferably at the most equal to 0.3 mm, and whose surface is at least partly metallized in a manner which is sure and easily controllable, bearing in mind that, in the course of fabrication, it is unnecessary to cause the metallization bath or jet to penetrate to the end of cavities having a closed contour, which would moreover be practically impossible, but that it is sufficient to suitably distribute it by means of usual techniques on the part of the interior face of the support or supports which corresponds to the future place of the cavities and which is then entirely accessible.

The invention also has for, its object a female electric connector element adapted to cooperate with plugs having a diameter preferably at the most equal to 0.3 mm, mainly characterized in that it is formed by two supports of insulating material, of which at least one is of elastic plastics material and which are assembed together with one interior face against the other interior face, the profiles of these two supports being such, as thus assembled, that they delimit therebetween a series of parallel cavities opening onto at least one of the transverse faces of the assembly of the two supports, the interior face of at least one of these supports being coated with at least one metallized track at the place of each cavity. As explained above in respect of the process, this definition of the female connector element does not exclude the use of more than two of such supports for constituting this element.

It is possible to introduce in each cavity having a surface thus partly or totally coated with at least one metallized track, through one or each of the aforementioned transverse faces, a practically indeformable plug whose diameter is slightly larger than the diameter of the circle inscribed within the cross-section (at rest) of said cavity and to establish an electric connection between this plug or these two plugs and the metallized track of the cavity, with a pressure due to the deformation of the or each support of elastic plastics material, this deformation being brought about by the insertion of the plug or plugs in this cavity.

It is to be noted that, in U.S. Pat. No. 4,416,498, it has already been proposed to constitute a female electric connector element either by a single support of elastic plastics material, or by the assembly of two supports adhered together, of which one is of an elastic plastics material and the other of a relatively rigid plastics material, this support of this assembly of two supports, delimiting a series of parallel cavities which open onto at least one of its transverse faces. Inserted in and adhered to each cavity is one or two contact strips which is or are adapted to be applied against a plug subsequently detachably inserted in this cavity, with a pressure due to the deformation of the elastic plastics material delimiting this cavity. The possible presence of two supports adhered together is necessitated simply by the fact that they are formed from two different materials, and this patent not only does not suggest taking advantage of the fact that the interior of the cavities is accessible before the assembly of the two supports but advises against the use of rubber materials rendered electrically conductive in specifying the exclusive use of metallic strip.

In order to better distinguish the invention from the prior art related to U.S. Pat. No. 4,416,498, it is well to note that the metallized tracks employed in accordance with the invention have thicknesses generally less than 0.1 mm and have in particular the following values, depending on the metal from which they are made:

copper: between 0.01 and 0.08 mm,
nickel: between 0.001 and 0.003 mm,
gold: between 0.005 and 0.025 mm.

In contrast to the metallic strips, these metallized tracks exactly follow the deformations of the subjacent elastic plastics material.

Other features and advantages of the invention will be apparent from the reading of the following complementary describtion which is illustrated by the accompanying drawings.

Figure 5:
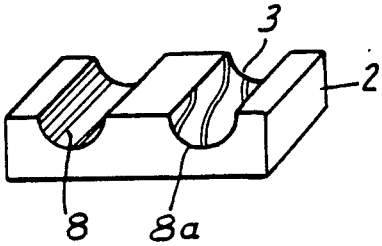
FIG. 5 shows, by way of example, the shape of the metallized tracks deposited on a support of one of the types illustrated in FIG. 1, shown in perspective.
Figure 9:
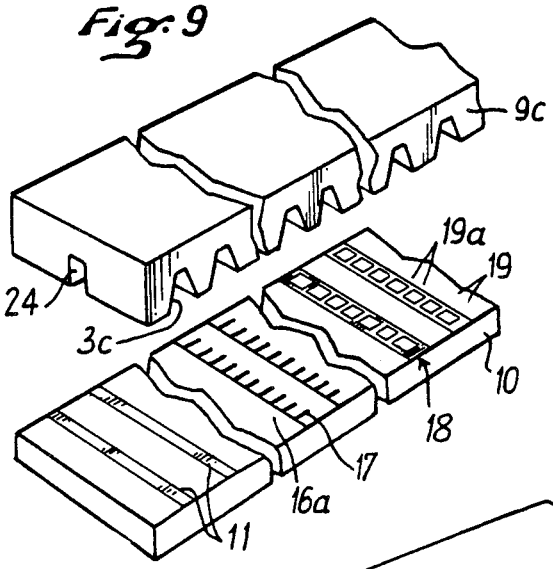
Figure 10:
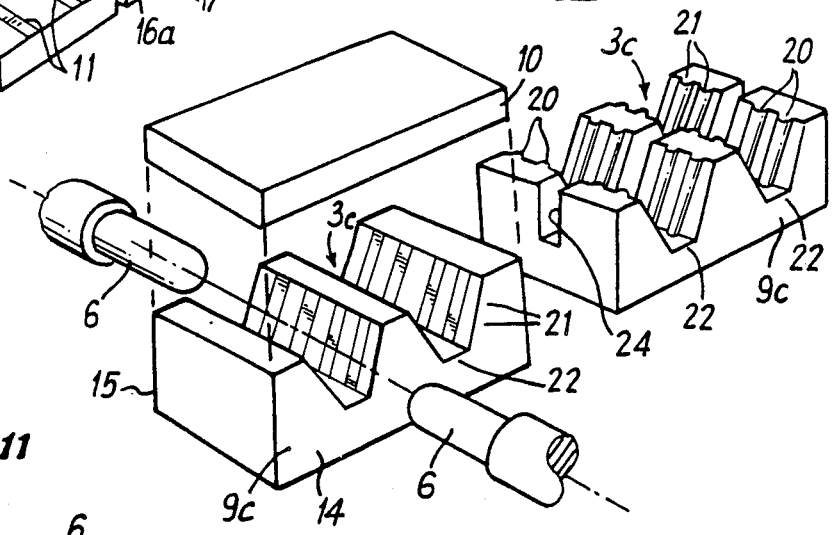

FIGS. 9 and 10 each show, in perspective, two supports adapted to constitute a female connector element constructed in accordance with fourth and fifth embodiments, and reveal metallized tracks formed in accordance with variations of those of FIG. 5.

Figure 11:
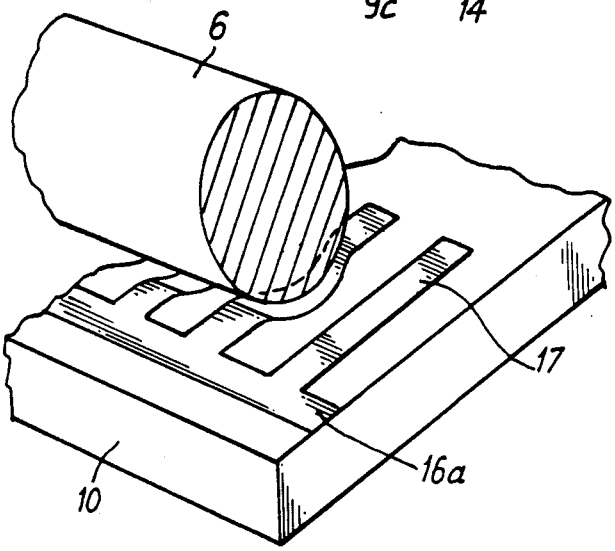
Figure 12:
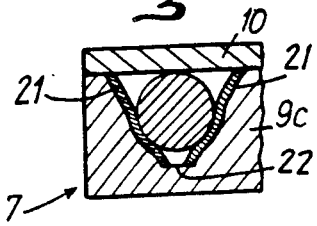
Figure 13:
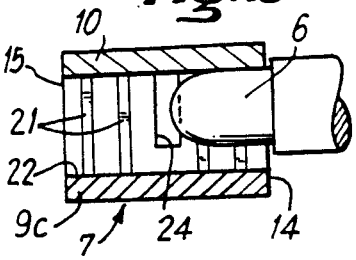

FIGS. 11, 12 and 13 illustrate the deformation of metallized tracks brought about by the introduction of a plug, FIG. 11 being a perspective view corresponding to one of the types of metallized tracks of FIG. 9, and FIGS. 12 and 13 being views respectively in cross-section and in longitudinal section corresponding to one of the types of metallized tracks of FIG. 10.

Figure 14:
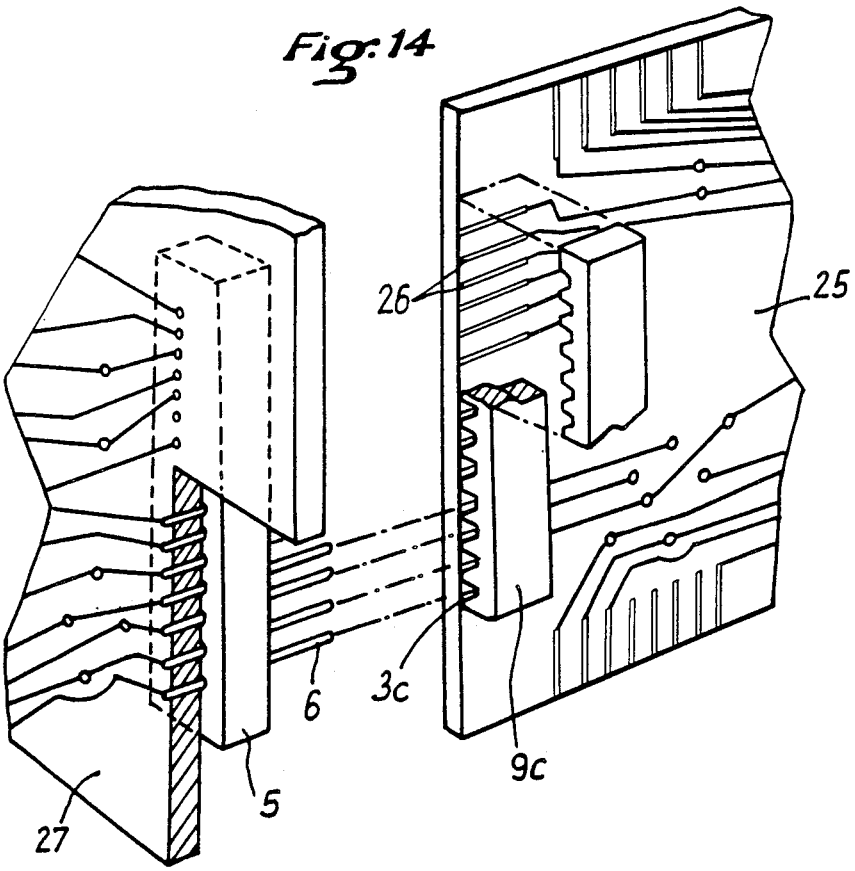

FIG. 14 illustrates, in perspective, a sixth embodiment of the invention applied to a connector for printed circuit boards.

Figure 15:
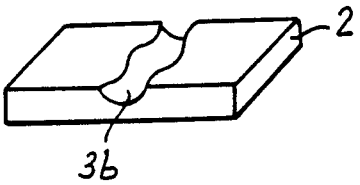

FIG. 15 represents, in perspective, a support constructed in accordance with a variation of FIG. 5.

Figure 2:
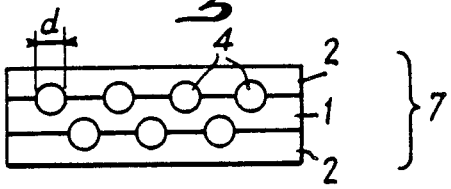
FIG. 2 shows, in end elevation, a female connector element constituted by the assembly of three supports which are chosen from the two types illustrated in FIG. 1.
Figure 16:
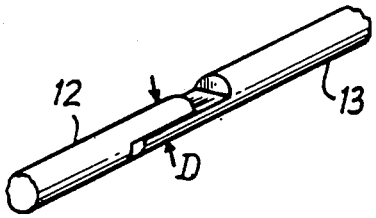

FIG. 16 represents, in perspective, two complementary plugs which may be used with the female connector element of FIG. 2.

Figure 1:
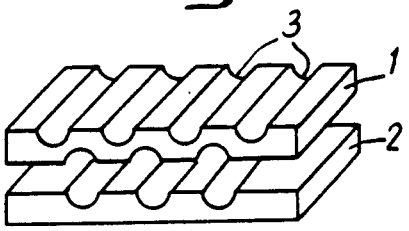
FIG. 1 shows separately and in perspective two types of supports adapted to constitute a female electric connector element according to a first embodiment of the invention.
Figure 6:
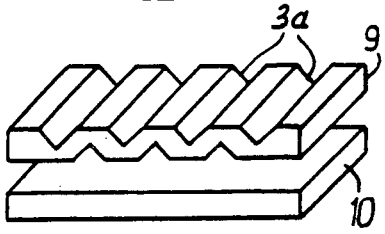
FIGS. 6 and 7 represent, by views respectively similar to those of FIGS. 1 and 2, on one hand, two types of supports of a female connector element constructed in accordance with a second embodiment of the invention and, on the other hand, this connector element itself.

Reference with first of all be made to FIGS. 1 to 14 which illustrate a first embodiment of the invention. In insulating supports of elastic plastics material, such as 1 and 2 (FIGS. 1 and 2), having roughly the shape of plates, there are provided parallel recesses 3 having for example a semi-circular profile in which, before assembly of these supports, there is effected in the known manner a metallization (for example with copper, gold, or other suitable metal or alloy), followed, as the case may be, by an electrolytic protective deposit. The metallized layer or the metallized tracks resulting from this metallization will be described hereinafter. In FIG. 1, the support 1 comprises recesses 3 on its two faces and the support 2 on only one of its faces. These different supports, for example two in number (two supports 2 united by their recessed faces), or three in number (a support 1 between two supports 2 as shown in FIG. 2), are then permanently assembled either by adhesion or by ultrasonic welding, for example, so as to constitute a female connector element 7 in which the recesses 3 form, in pairs, a cavity 4 (FIG. 2) of closed profile (circular in the illustrated example).

Figure 3:
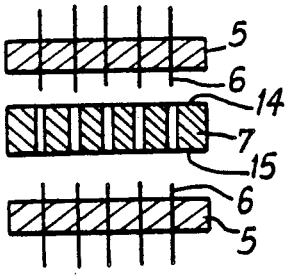
FIGS. 3 and 4 show, in section through a plane passing through a series of cavities, a connector comprising a female element according to this first embodiment, respectively before and after a unilateral plugging together.
Figure 4:
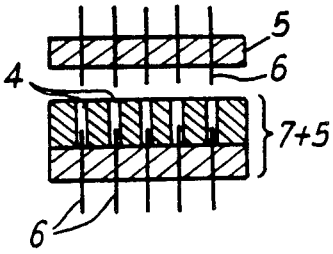

As shown in FIG. 3, there may be constituted a connector having three principal elements: two similar male connector elements 5 each provided with parallel plugs 6 and a female connector element 7 provided with cavities 4 which open onto the two transverse faces 14 and 15 and which, in the unilateral plugged-in position presented in FIG. 4, permit the electric connection of the plugs 6 of one of the male connector elements 5 respectively to the aligned plugs 6 of the other male element 5. It will be understood that, as represented in FIG. 4, the female connector element 7 may be permanently connected (by adhesion, ultrasonic welding or like process) to one (represented at the bottom of FIG. 5) of the male connector elements 5, the other male element 5 (represented at the top of FIG. 4) being, as desired, plugged in or not plugged in, in the case of connection or disconnection.

According to a first variation, only the support 1 could be formed of an elastic plastics material, the support 2 then being of a practically rigid plastics material. According to another variation, the cavities 4 could open out only onto one of the transverse faces, the face 15 (FIG. 3) for example. In this case, the metallized tracks of these cavities could be connected to circuit elements, on one side, by plugs such as 6 and, on the other side, by means other than plugs, such as for example soldered wires.

The process of fabrication which was described with reference to FIGS. 1 and 4 affords many advantages other than the principal advantage of producing subminiature connectors. Indeed, the fabrication of all the elements of these connectors may be rendered automatic. Further, in the case where each connector has two male elements 5, these two elements are identical, which facilitates supplies and maintenance. When the plugs 6 are inserted in the cavities 4 of the female connector element 7, the elastic plastics material totally or partly delimiting each cavity 4 is elastically deformed, as will be explained in more detail below, in producing the pressure of contact, and the electric connection with the plug is assured by the metallization deposit formed in this cavity.

Figure 7:
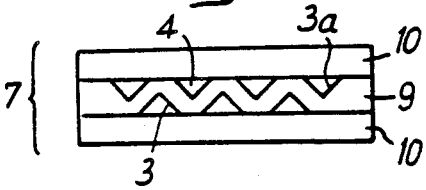
Figure 8:
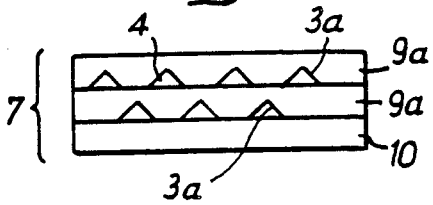
FIG. 8 shows, by a view similar to that of FIGS. 2 and 7, a female connector element constructed in accordance with a third embodiment of the invention.

As mentioned above, FIGS. 1 and 2 represent recesses 3 having an open semi-circular profile so as to produce, in pairs, cavities 4 having a closed circular profile. They may also have a triangular shape, as the recesses 3*a* of FIG. 6, or a trapezoidal shape, as the recesses 3*c* of FIG. 9, and may be formed in this case either on the two supports, as in the case of the insulating support 9 of FIG. 7, or preferably on the sole insulating support 9 (FIG. 6) or 9*c* (FIG. 9), the other support 10 being then planar. The female connector element 7 is then either in accordance with FIG. 7 in which a support 9, provided with recesses 3*a* on both its faces, is sandwiched between two planar supports 10, or in accordance with FIG. 8 in which two supports 9*a*, having recesses 3*a* on a single one of their faces, are superposed on a planar support 10, or in accordance with FIG. 9 in which a support 9*c*, having recesses 3*c* on a single one of its faces, is placed on a planar support 10. In these three cases, the closed profile of the cavity 4 is identical to the open profile of the triangular recess 3*a* or the trapezoidal recess 3*c*. As explained below, this triangular or trapezoidal shape permits the gripping of a plug, such as 6, on three generatrices. In the case of FIGS. 7, 8 and 9, if the recessed supports 9, 9*a* or 9*c* are made from an elastic plastics material, the non-recessed supports 10 may be made either also from an elastic plastics material, or preferbly from a non-elastic plastics material.

Although the deformation of the plastics material is small, it is advantageous, in order to improve reliability, to effect the metallic deposit in each cavity 4, not on the whole of the surface of the cavity but along relatively narrow metallized tracks capable of assuring the electric continuity from one end to the other of the cavity.

In the case of the recesses 3 of semi-circular profile provided in a support 2 of elastic plastics material, there may be used, for example, as shown in FIG. 5, metallized tracks 8 disposed along generatrices (rectilinear) of the semi-cylindrical surface of the recess 3 or metallized tracks 8*a* disposed parallel to one another along sinuous paths from one end to the other of the recess 3. These metallized tracks 8 or 8*a* therefore follow paths which practically cannot be deformed when introducing a plug 6.

In the case where the female connector element 7 comprises a planar support 10, the metallized tracks may, according to a first solution illustrated in FIG. 9, be formed solely on this planar support 10, whether the latter be of elastic plastics material or practically rigid. FIG. 9 illustrates three possible shapes for such metallized tracks: rectilinear tracks 11, comb-shaped tracks 16 with teeth 17, and ladder-shaped tracks 18 having transverse rungs 19 and side members 19*a*.

FIG. 11 illustrates the deformation of a metallized comb-shaped track 16 of FIG. 9 which is provided from one end to the other of a cavity 4 on a support 10 of elastic plastics material so that the continuous track 16*a* constituting the back of the comb is laterally offset relative to the center of the cavity. It can thus be seen that the plug only touches the teeth 17 and consequently the deformation produced on the support 10 by the insertion of a plug 6 is localized on these teeth 17 and does not concern the continuous track 16*a*. The latter is neither liable to be worn by rubbing nor liable to be flaked by the deformation of the support 10. The same effect is obtained with the ladder-shaped metallized tracks 18 of FIG. 9, each of the side members 19*a* of the ladder behaving as the continuous metallized track 16*a* of FIG. 11. This improves the reliability of the connection by multiplication of the points of contact.

According to the variation of the embodiment described with reference to FIGS. 9 and 11, the metallized tracks, such as 11,16 and 18, could be provided on a planar support which is not elastic but relatively rigid, the insertion of the plug 6 then causing the deformation of the support 9*c* having recesses 3*c*. In any case, as they are not metallized, these recesses 3*c* of the support 9*c* merely serve to transmit the pressure of the plug 6 against the metallized tracks of the other support 10.

In order to facilitate the deformation of the elastic plastics material, it is possible to provide in the recesses such as 3, 3*a* and 3*c*, whether they have a semicircular, triangular or polygonal profile, longitudinal or transverse bosses on which a metallization is deposited and, among others, splines or ribs which are parallel or perpendicular to the axis of the cavity, or even inclined relative to this axis, and obtained, when molding the support of insulating material, by the use of mandrels in which have been provided grooves, the latter being parallel, perpendicular or inclined relative to the axis and corresponding to said splines or ribs.

Thus, in the right part of FIG. 10, there has been shown a support 9*c* whose cavities 3*c* include transverse bosses 20 which carry the sole metallized tracks 21 with which the plugs 6 come into contact.

The transverse metallized tracks 21 are electrically interconnected through a longitudinal metallized track 22 formed in the bottom of the trapezoidal recess 3*c*, which therefore avoids risks of wear by rubbing and flaking by repeated deformations, like the longitudinal track 16*a* of FIGS. 9 and 11. Tracks 21 have been shown in the left part of FIG. 10 which are similar to those of the right part, the sole difference being the absence of bosses such as 20.

If the support 9*c* is composed of elastic plastics material and the support 10 of a non-elastic plastics material, the insertion of a plug such as 6 causes the deformation of each transverse track 21, as shown in FIG. 12, without deformation of the longitudinal track 22. The presence of hollows between bosses 20 (FIG. 10) or of a central recess 24 (see FIG. 13), has the advantage that the transverse tracks 21 are deformed independently of each other, which prevents the localized deformations due to the insertion of a first plug 6 (see the right side of FIGS. 10 and 13) in one of the transverse faces 14 of the female connector element 7, from being propagated to the other transverse face 15 and consequently disturbing the contact upon the insertion of a second plug in the other transverse face 15.

In the foregoing, it was assumed that each of the supports of insulating material constituted an element specially fabricated for the female connector element. In fact, one of the supports, in particular when it concerns a planar support of a practically non-deformable insulating material, may be part of an electric or electronic component, such as a printed circuit board. FIG. 14 shows the application of the invention to the connection between a mother board 27 and a daughter board 25 provided, on at least one of its edges, with metallized connecting tracks 26. It is then sufficient to adapt to the mother board 27 a male connector element 5 of the type represented in FIGS. 3 and 4 and to use the daughter board 25 as a substantially rigid planar support, similar to those designated by the reference numeral 10 in FIGS. 6, 7, 8 and 9. There are therefore added to the daughter board 25, by adhesion or ultrasonic welding or some other process, recessed supports such as that designated by the reference numeral 9*c* in FIG. 9, while causing their recesses 3*c* to coincide with the tracks 26, which then perform the function of the tracks 11 on FIG. 9.

As illustrated in FIG. 16, the invention also contemplates the use of the insulating plastics material (elastomeric, thermoplastic or other material) for imparting a pressure of contact to the united parts of two plugs 12,13 disposed in end-to-end and overlapping relation in the same cavity 4 whose diameter at rest is less than the diameter of the united parts of these plugs. The two indeformable plugs 12 and 13 have circular profiles of the same diameter D and terminate in complementary, for example semi-circular, profiles which are capable of uniting and together form a circular profile of diameter D, this diameter being larger than the diameter D at rest of the cavity 4 (see FIG. 2). The deformation of the elastic plastics material of the supports 2 or the like, due to the insertion of the plugs 12 and 13 in directions toward each other in the same cavity 4, assures the pressure of contact not only of each of the plugs against the metallization of the cavity 4 but also of the united parts of the plugs one against the other. When one of the supports is of a non-elastic material, it enables the plug 6 to be centered with more precision than if it were of an elastic material.

Another possibility, among others, is to form recesses 3*b* having small variations in diameter in the direction of the length, as represented in FIG. 15.

As with the cavities 4, the plugs 6,12 and 13 may be of round, rectangular or polygonal section without departing from the spirit of the invention. They may be made from a machined metal rod or from the bared end of a conductor wire. When it concerns a machined metal rod, these plugs are preferably coated with an electrolytic protection (nickel plus gold for example).

In the foregoing, it was not considered necessary to describe the process for the metallization of the cavities, since such processes are well-known in the art. By way of example, there may be mentioned the metallization process employing the serigraphy of inks containing metals proposed by the U.S. firm General Electric and briefly described in the French review "Industrie et Technique" No. 554, page 80 of Feb. 20, 1985.

What is claimed is:

1. A female electric contact element adapted to cooperate with plugs having a diameter preferably at the most equal to 0.3 mm, comprising:

two supports which are formed from at least two separate pieces of insulating material, at least one of which supports is of an elastic material and which supports are assembled together into an assembly having opposed transverse faces and having one interior face against the other interior face, the facing surface of said supports being shaped such that, when assembled with said facing surfaces facing each other, they delimit therebetween a series of parallel cavities opening into at least one of said transverse faces of the assembly, the interior face of at least one of said supports being coated with at least one metallized track within each cavity, said metallized tracks comprising separate transverse parts shaped and positioned to contact an inserted plug, and at least one longitudinal part which is offset relative to surfaces of the cavity contacted by the plug or plugs and electrically connected to the transverse parts and providing electrical continuity from one of said transverse faces to the other of said transverse faces.

2. A connector element according to claim 1, wherein there is formed in the supports at least one transverse hollow cut-out formed into the side of the cavities intermediate between said transverse faces.

3. A connector element according to claim 1, wherein said cavities are each constituted by two opposed recesses respectively provided in each of the two facing assembled supports.

4. A connector assembly according to claim 3, wherein each recess is provided with a plurality of metallized tracks which are arranged parallel to one another and extend from one transverse face of the assembly to the other transverse face of the assembly.

5. A connector element according to claim 3, wherein said cavities have a circular cross section when said elastic material is at rest, each recess having a semicircular cross section.

6. A connector element according to claim 1, wherein the cavities are each constituted by a recess provided in one of the supports and limited by a planar portion of the other support.

7. A connector element according to claim 6, wherein the support having the said planar portion is constituted by a printed circuit board.

8. A connector element according to claim 6, wherein each recess has a polygonal profile.

9. A connector element according to claim 8, wherein said polygonal profile is triangular.

10. A connector element according to claim 8, wherein each polygonal profile is trapezoidal.

11. A female electric contact element adapted to cooperate with plugs having a diameter preferably at the most equal to 0.3 mm, comprising:

two supports which are formed from at least two separate pieces of insulating material, at least one of which supports is of an elastic material and which supports are assembled together into an assembly having opposed transverse faces and having one interior face against the other interior face, the facing surfaces of said supports being shaped such that, when assembled with said facing surfaces facing each other, they delimit therebetween a series of parallel cavities opening into at least one of said transverse faces of the assembly, the interior face of at least one of said supports being coated with at least one metallized track within each cavity, each said cavity including raised bosses extending transversely intermediate said transverse faces, and said metallized tracks being formed on said raised bosses.

12. A connector element according to claim 11, wherein the cavities are each constituted by a recess provided in one of the supports and limited by a planar portion of the other support.

13. A connector element according to claim 12, wherein each recess has a polygonal profile.

14. A connector element according to claim 13, wherein each polygonal profile is trapezoidal.

* * * * *